United States Patent [19]

Fox

[11] 3,964,117

[45] June 22, 1976

[54] COMBINED BOOT JACK AND SHAPER

[76] Inventor: Dale H. Fox, 10218 Eden Court, NE., Albuquerque, N. Mex. 87112

[22] Filed: Apr. 7, 1975

[21] Appl. No.: 565,661

[52] U.S. Cl. ..... 12/120.5; 223/114
[51] Int. Cl.[2] ..... A43D 5/00; A47J 51/02
[58] Field of Search ..... 223/114, 117; 12/120.5

[56] References Cited

UNITED STATES PATENTS

| | | | |
|---|---|---|---|
| 1,106,465 | 8/1914 | Loomis | 12/120.5 |
| 1,178,109 | 4/1916 | Staubly | 223/114 |
| 2,566,656 | 9/1951 | David | 12/120.5 |
| 3,784,067 | 1/1974 | Hicks | 223/114 |

*Primary Examiner*—Patrick D. Lawson
*Attorney, Agent, or Firm*—Clarence A. O'Brien; Harvey B. Jacobson

[57] ABSTRACT

A generally horizontal panel member having upper and lower surfaces and first and second front and rear ends is provided. The central portion of the forward end of the panel member has an edgewise outwardly opening generally U-shaped notch formed therethrough for seatingly receiving the heel portion of a boot therein with the toe portion of the boot projecting outwardly and forwardly of the forward edge portion of the panel member. The forward edge portion of the panel member, on opposite sides of the notch, includes upstanding flanges which terminate upwardly in rearwardly deflected horizontal flanges beneath which the toe portions of the soles of a pair of boots may be received with the undersurface of the sole portions of the boots at the toe ends thereof disposed in contact with the upper surface of the panel member and the weight of the heel portions of the boots preventing the toe portions of the soles thereof from curling upwardly.

8 Claims, 3 Drawing Figures

COMBINED BOOT JACK AND SHAPER

BACKGROUND OF THE INVENTION

Various forms of boot jacks have been provided to assist the wearer of a pair of boots in removing boots from his feet. Examples of generally conventional boot jacks are disclosed in U.S. Pat. Nos. 36,292, 129,936, 250,655, 374,076, 612,764 and 2,876,942. However, when boots are worn the interiors thereof often become damp with perspiration and if the boots are not blocked upon their removal, air drying of the boots may cause the toe portions thereof to curl upwardly. Previously known boot jacks do not include structure whereby the toe portions of boots having been removed through the utilization of the boot jacks may be prevented from curling upwardly.

BRIEF DESCRIPTION OF THE INVENTION

The boot jack of the instant invention includes the general structural features of conventional boot jacks but further includes upstanding and rearwardly directed flanges closely overlying the upper surfaces of the panel portion thereof on opposite sides of the boot heel receiving notch of the boot jack and after a pair of boots have been removed through utilization of the boot jack, the sole portions of the boots may be placed upon the upper surface of the boot jack on opposite sides of the heel receiving notch formed therein with the toe portions of the soles of the boots hooked beneath the aforementioned flanges in order to prevent the toe portions of the boots from curling upwardly.

The main object of this invention is to provide a convenient structure whereby boots may be temporarily stored after usage in a manner preventing the toe portions of the boots from curling upwardly.

Inasmuch as the several hours following the removal of a pair of boots are those critical hours in which the toe portions of the boots may tend to curl upwardly, it is a further object of this invention to provide an apparatus in accordance with the immediately preceding object operatively associated with an otherwise conventional form of boot jack, thereby rendering the invention extremely convenient to use.

Another object of this invention is to provide a combined boot jack and shaper constructed in a manner whereby boots of various sizes may be supported therefrom in a manner to prevent the toe portions of the boots from curling upwardly.

A final object of this invention to be specifically enumerated herein is to provide an apparatus in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
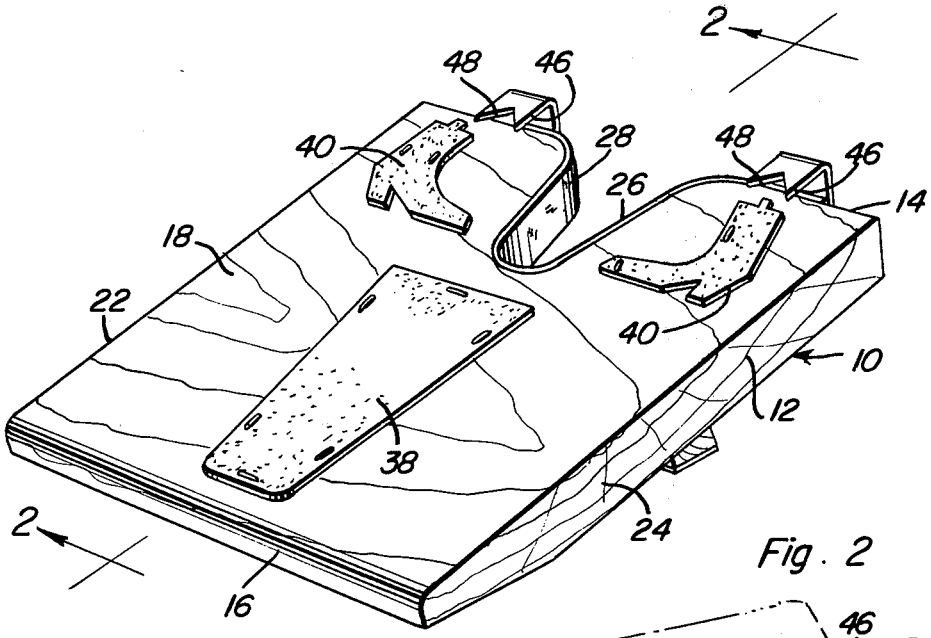
FIG. 1 is a perspective view of the combined boot jack and shaper of the instant invention.
Figure 2:
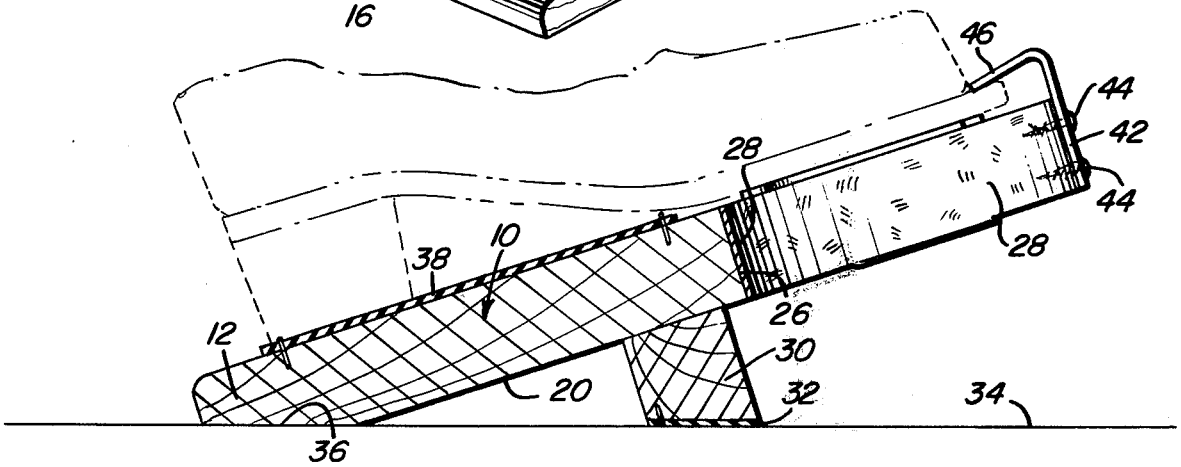
FIG. 2 is an enlarged vertical sectional view taken substantially upon the plane indicated by the section line 2—2 of FIG. 1 and with the lower portion of a boot supported in stored position from the boot jack and shaper illustrated in phantom lines.
Figure 3:
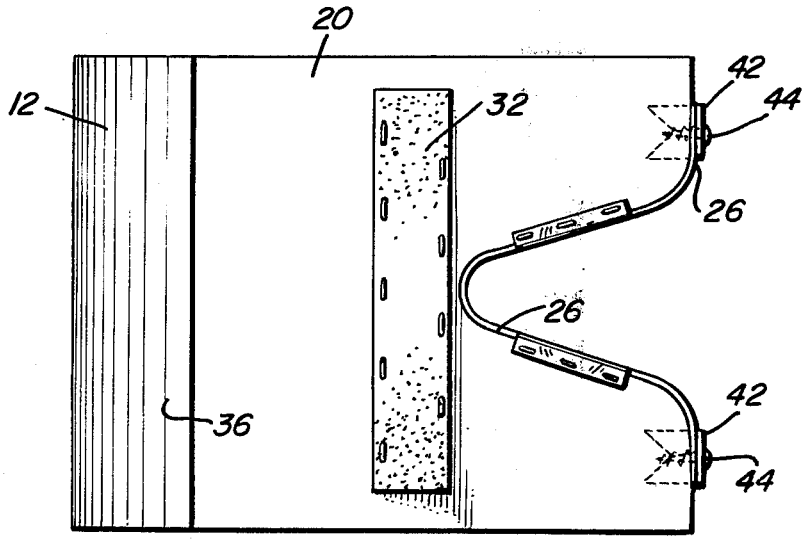
FIG. 3 is a bottom plan view of the invention.

Referring now more specifically to the drawings the numeral 10 generally designates the combined boot jack and shaper of the instant invention. A generally horizontal panel member 12 is provided including a forward marginal edge 14, a rear marginal edge 16, an upper surface 18, a lower surface 20 and opposite side longitudinal edges 22 and 24.

The forward end portion of the panel member 12 has a forwardly opening generally U-shaped notch formed therein which opens through the forward marginal edge 14 of the panel member 12 centrally intermediate the opposite ends of the forward marginal edge portion 14. The notch is designated by the reference numeral 26 and is lined by a strip 28 of cushioning material secured over those edge portions of the panel member 12 defining the notch 26. The opposite end portions of the strip 28 extend outwardly of the notch and over the adjacent portions of the opposite side portions of the forward marginal edge portion 14 of the panel member 12.

A depending foot 30 has its upper portion secured to the undersurface 20 of the panel member 12 and projects downwardly from the panel member 12 a spaced distance rearward of the inner end of the notch and forward of the longitudinal center of the panel member 12. The lower end of the foot 30 is provided with a non-skid covering 32 for engagement with the floor surface 34 upon which the structure 10 rests. In addition, the rear marginal portion of the undersurface 20 of the panel member 12 is beveled as at 36 to conform to the floor 34.

The central rear portion of the upper surface 18 of the panel member 12 is provided with a non-skid covering 38 and smaller non-skid covering sections 40 are secured to opposite side portions of the forward end portion of the upper surface 18 on opposite sides of the notch 26 for a purpose to be hereinafter more fully set forth.

A pair of upstanding flanges 42 have their lower ends overlying opposite ends of the strip 28 and secured to the adjacent underlying portions of the forward marginal edge face of the panel member 12. In this manner, the fasteners 44 utilized to secure the lower ends of the upstanding flanges 42 to the forward marginal edge of the panel member 12 also serve to secure the opposite ends of the strip 28 in position. The upper ends of the flanges 42 terminate in rearwardly directed flange portions 46 which closely overlie the upper surface 18 of the panel member 12 on opposite sides of the notch 26, the non-skid panels 40 being substantially registered with and disposed beneath the flange portions 46 and the rear marginal edge portions of the flange portions 46 being notched as at 48.

In operation, the boot jack or assembly 10 is utilized in the conventional manner to assist the wearer of a pair of boots in removing his boots. After a pair of boots have been removed, the boots are placed upon the upper surface 18 of the panel member 12 on opposite sides of the notch 26 with the forward end portion of the sole portions of the boots held captive beneath the notched rear marginal edges of the flange portions 46. In this manner, the weight of the heel end portions of the boots will maintain the forward sole portions of the boots in substantially planar condition in surface-to-surface contacting relation with the upper surface 18 of the panel member 12, except in the areas of the upper surface 18 covered by means of the non-skid panels 40, which non-skid panels 40 serve to prevent displacement of the boots relative to the assembly 10 and disengagement of the forward toe portions of the soles of the boots from the flange portions 46.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A combined boot jack and shaper including a generally horizontal panel member having upper and lower surfaces and a first pair of opposite marginal edge portions interconnected at corresponding ends by a second pair of opposite marginal edge portions extending therebetween, one edge portion of said first pair of marginal edge portions having an edgewise outwardly opening generally U-shaped notch formed therethrough intermediate and spaced inwardly of said second pair of edge portions and adapted to seatingly receive the heel portion of a boot therein with the toe portion of the boot projecting outwardly of said one edge portion, said one edge portion of said panel member, on opposite sides of said notch, including means defining a pair of abutment surfaces spaced above and facing downwardly toward the portions of said upper surface disposed therebeneath, said boot jack and shaper being free of obstructions between at least the marginal portions of said downwardly facing surfaces adjacent the other edge portion of said first pair of marginal edge portions and said upper surface and the spacing between said downwardly facing abutment surfaces and the opposing portions of said upper surface being slightly greater than the thickness of the toe portion of the sole of a conventional pair of boots, whereby the forward extremities of the soles of a pair of boots may be received between said downwardly facing abutment surfaces and said upper surface with the heel portions of the boots resting upon said upper surface to prevent upward curling of the forward sole portions of said boots.

2. The combination of claim 1 wherein said downwardly facing surfaces are defined by a pair of flanges generally paralleling said panel member and including rear edge portions facing toward the other edge portion of said first pair of marginal edge portions, the front marginal edges of said flanges being carried by the upper portions of a pair of upstanding flange members supported from and projecting above said panel member.

3. The combination of claim 1 wherein the lower ends of said upstanding flange members overlap and are secured to the edge face of said one edge portion.

4. The combination of claim 1 including a cushioning strip secured to and overlying at least a substantial portion of the edge face of said panel member defining said notch.

5. The combination of claim 1 wherein said panel member includes a vertically depending foot spaced rearward of the inner end of said notch and forward of the longitudinal center of said panel member.

6. The combination of claim 5 wherein said downwardly facing surfaces are defined by a pair of flanges generally paralleling said panel member and including rear edge portions facing toward the other edge portion of said first pair of marginal edge portions, the front marginal edges of said flanges being carried by the upper portions of a pair of upstanding flange members supported from and projecting above said panel member.

7. The combination of claim 6 wherein the lower ends of said upstanding flange members overlap and are secured to the edge face of said one edge portion.

8. The combination of claim 7 including a cushioning strip secured to and overlying at least a substantial portion of the edge face of said panel member defining said notch.

* * * * *